US006382532B1

(12) United States Patent
French et al.

(10) Patent No.: US 6,382,532 B1
(45) Date of Patent: May 7, 2002

(54) OVERMOLD CONSTRAINED LAYER DAMPER FOR FUEL INJECTORS

(75) Inventors: Richard Mark French, Livonia; Maria Catherine Nowland, Saline, both of MI (US); Christopher Martin Louis, Hanahan, SC (US)

(73) Assignee: Robert Bosch Corporation, Broadview, IL (US)

( * ) Notice: Subject to any disclaimer, the term of this patent is extended or adjusted under 35 U.S.C. 154(b) by 1 days.

(21) Appl. No.: 09/644,637

(22) Filed: Aug. 23, 2000

(51) Int. Cl.[7] ..... F02M 51/00
(52) U.S. Cl. ..... 239/585.1; 251/129.21
(58) Field of Search ..... 239/585.1–585.5, 239/900; 251/129.15, 129.21

(56) References Cited

U.S. PATENT DOCUMENTS 4,742,964 A 5/1988 Ito et al.
5,094,217 A 3/1992 Kaku et al.
5,207,387 A * 5/1993 Bergstrom ..... 239/585.4
5,823,446 A 10/1998 Bennett et al.
5,967,419 A 10/1999 Yamaguchi et al.
5,975,053 A 11/1999 Rodier
6,178,950 B1 * 1/2001 Stockner et al. ..... 123/469

OTHER PUBLICATIONS

A. Nashif, D. Jones, and J. Henderson, Vibration Damping, pp. 278–285.

* cited by examiner

*Primary Examiner*—Lesley D. Morris
(74) *Attorney, Agent, or Firm*—Michael Best & Friedrich LLP

(57) ABSTRACT

A fuel injector assembly including a body portion, a valve seat fixed relative to the body portion, a valve member movable relative to the valve seat, an outer layer substantially surrounding the body portion, and a damping material between the body portion and the outer layer, the damping material cooperating with the outer layer to dampen noise and vibration produced during operation of the fuel injector. Preferably, the fuel injector also includes an electrical connector mounted on the body portion, and the damping material is adjacent the electrical connector. In the preferred embodiment, the damping material is a viscoelastic material.

33 Claims, 2 Drawing Sheets

OVERMOLD CONSTRAINED LAYER DAMPER FOR FUEL INJECTORS

FIELD OF THE INVENTION

The invention relates to fuel injectors and more particularly to methods of attenuating noise and vibration created by fuel injectors.

BACKGROUND OF THE INVENTION

Electromagnetic fuel injectors are common in modern fuel-injected internal combustion engines. The fuel injectors deliver fuel to the engine in metered pulses which are appropriately timed to the engine operation. To produce the metered pulses of fuel, electromagnetic fuel injectors typically include a metallic valve member that is actuated by an electromagnetic coil to open and close the fuel valve. When the valve member is actuated to open the fuel valve, the top portion of the valve member, or armature, reaches its upper limit of travel and strikes a metallic support tube. The metal-to-metal contact sends an impulse through the injector that is radiated from the exterior surface of the injector as noise and vibration.

Likewise, when the valve member closes the fuel valve, the bottom portion, or valve ball, reaches its lower limit of travel and strikes a metallic valve seat. Again the metal-to-metal contact sends an impulse through the injector that is radiated from the exterior surface of the injector as noise and vibration.

Recent advances in vibration and background noise reduction inside the passenger compartment of vehicles have increased the demand for quieter running engines. Reduced background noise in the passenger compartment has made previously inaudible engine noises, such as injector noise, audible. Only recently has injector noise begun to spark serious consumer complaints.

Various attempts have been made to reduce the noise and vibration emanating from fuel injectors. As time has passed, the methods have become more complex and more expensive. One early attempt, U.S. Pat. No. 5,094,217 disclosed an insulating housing that encircles and encloses at least a portion of the fuel injectors to deaden the sound.

More recently, U.S. Pat. No. 5,823,446 disclosed the use of an elastomeric ring disposed between the bushing and the valve body to provide an insulating layer tending to dampen noise and vibration when the valve is open and fuel is flowing therethrough.

Even more recently, U.S. Pat. No. 5,967,419 disclosed the use of a cylindrical sound insulating member that is disposed inside the fuel passage of the fuel injector. The sound insulating member prevents the operating sound of the valve from being transmitted to the delivery pipe, thereby suppressing emission of the operating sound of the valve through the delivery pipe to the outside.

Most recently, U.S. Pat. No. 5,975,053 disclosed varying the timing, duration and amplitude of the electrical pulse to the fuel injector, in response to changes in working fluid pressure, to reduce the noise emitted.

In addition to the above-mentioned techniques used for fuel injectors, larger scale vibration reducing techniques are commonly used in various other fields, such as the aerospace and automotive body manufacturing industries. One well-known vibration damping technique is known as constrained layer damping or shear damping. Constrained layer damping is a technique wherein a damping layer of material is applied to a surface and is constrained by an outer layer having a relatively high in-plane stiffness. When the surface and the damping layer are subjected to cyclic bending due to vibration, the stiff constraining layer will constrain the damping material and force the damping material to deform in shear. The shear deformation dissipates the vibration energy and dampens the noise and vibration.

Typically, a soft aluminum tape is generously applied to the wings of aircraft or the inside of automotive body panels to dampen the vibration and noise created during travel. The tape consists of an adhesive that acts as the damping layer, and a metallic backing that acts as the constraining layer. Application of the tape to areas experiencing high vibrations will substantially attenuate the vibration and any resulting noise.

SUMMARY OF THE INVENTION

As modem vehicles continue to run more quietly, and injector noise becomes a bigger consumer issue, greater and more cost effective improvements over the prior art methods of attenuating injector noise are needed. The present invention provides an improved method for deadening the sound and vibration produced during operation of electromagnetic fuel injectors. A constrained layer damping technique is incorporated for the first time in fuel injector manufacturing to provide significant noise and vibration damping at a low cost.

To account for the materials commonly used in fuel injectors, and to keep the added costs to a minimum, the constrained layer damping technique has been slightly modified. Instead of using aluminum tape with the usual metallic constraining layer, the present invention utilizes the existing plastic overmolding of the fuel injector as the constraining layer. Therefore, only the addition of a damping layer is needed to effectively enjoy the benefits of constrained layer damping with existing fuel injectors.

The general concept remains the same, however, in that the damping layer is constrained between two relatively stiffer layers of material, namely the body portion of the injector and the plastic overmolding. As used herein and in the appended claims, the terms "stiff" and "stiffer" refer to a material having a higher modulus of elasticity than the material used in the damping layer. The terms "stiff" and "stiffer" are not meant to imply a specific modulus of elasticity or to otherwise limit the materials that can be used in any way.

When the relatively stiff body portion of the injector is subjected to cyclic bending due to vibration, the relatively stiff outer layer or overmolding constrains the damping material and forces the damping material to deform in shear. The shear deformation dissipates the vibration energy and dampens the noise and vibration in the injector. By adding a damping layer, preferably a viscoelastic material, between the body portion and overmolding, the benefits of the constrained layer damping technique can be realized for electromagnetic fuel injectors.

More specifically, the invention provides a fuel injector assembly including a body portion, a valve seat fixed relative to the body portion, a valve member movable relative to the valve seat, an outer layer substantially surrounding the body portion, and a damping material between the body portion and the outer layer, the damping material cooperating with the outer layer to dampen noise and vibration produced during operation of the fuel injector. Preferably, the fuel injector also includes an electrical connector mounted on the body portion, and the damping material is adjacent the electrical connector. In the preferred embodiment, the damping material is a viscoelastic material.

The invention also provides a method of using constrained layer damping to attenuate noise and vibration in a fuel injector assembly having a first stiff layer and a second stiff layer. The method includes sandwiching a damping layer between the first and second stiff layers. Preferably, the first stiff layer is metallic and the second stiff layer is a plastic that is molded over the first stiff layer and the damping layer.

Other features and advantages of the invention will become apparent to those skilled in the art upon review of the following detailed description, claims, and drawings.

Figure 1:
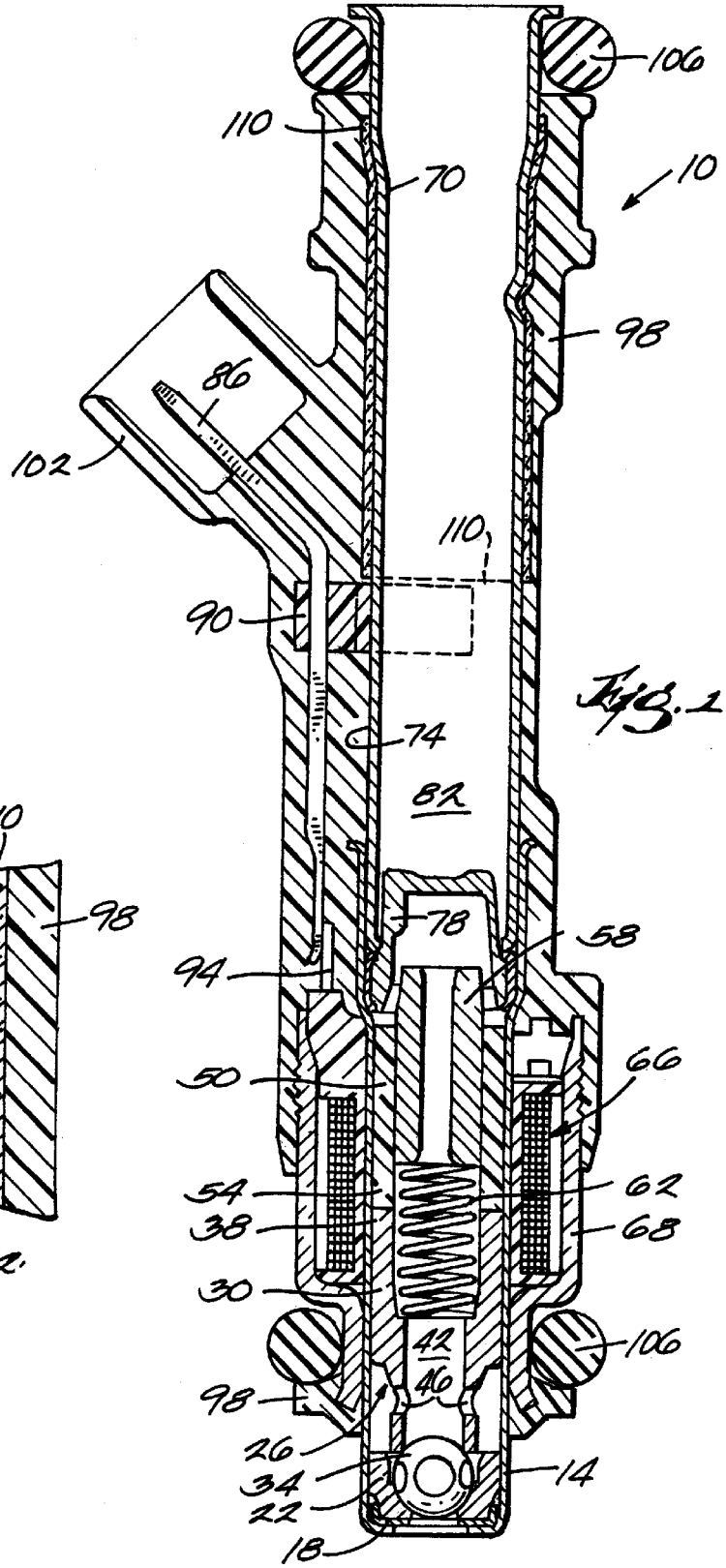
FIG. 1 is a section view of a fuel injector embodying the invention.
Figure 2:
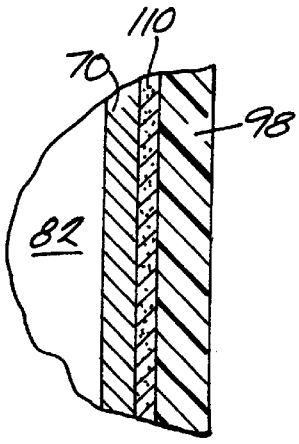
FIG. 2 is an enlarged section view of a portion of the fuel injector of FIG. 1.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIG. 1 illustrates a fuel injector 10 embodying the invention. The fuel injector 10 includes a metallic jacket 14. Inside the jacket 14 is an orifice plate 18 adjacent the lower end of the jacket 14. As used herein and in the appended claims, the terms "upper," "lower," "above," and "below" are used only for purposes of illustration and do not imply any particular orientation or configuration. The orifice plate 18 includes an orifice that is coaxial with an orifice in the lower end of the jacket 14. The orifice in the orifice plate 18 and the orifice in the lower end of the jacket 14 provide fluid communication between the fuel injector 10 and the combustion chamber (not shown). Adjacent the orifice plate 18 is a metal valve seat 22, the purpose of which will be described below.

The jacket 14 also houses a valve member or needle assembly 26 having an armature 30 and a ball member 34. The armature 30 has an upper end 38 and a bore 42. Holes 46 provide fluid communication between the bore 42 and the interior space of the jacket 14. The ball member 34 is mounted on the lower end of the armature 30 in any suitable manner to form the valve member 26 that is movable relative to the jacket 14. Typically the armature 30 and the ball member 34 are both metallic and the ball member 34 is welded to the armature 30. The ball member 34 is appropriately sized to be received in the valve seat 22. Together, the valve member 26 and the valve seat 22 operate as a fuel valve that selectively opens and closes the injector 10.

The jacket 14 also houses a support tube 50. The support tube 50 is typically made from metal and includes a lower end 54 adjacent the upper end 38 of the armature 30. The support tube 50 also includes a bore that houses at least a portion of an adjustment sleeve 58 and at least a portion of a spring 62. The spring 62 is constrained between the lower end of the adjustment sleeve 58 and a seat inside the armature bore 42. The adjustment sleeve 58 is adjustably fixed relative to the jacket 14 and biases the spring 62 against the seat in the armature bore 42, thereby biasing the valve member 26 into a first position, wherein the ball member 34 rests in the metal valve seat 22 and blocks fluid communication between the fuel injector 10 and the combustion chamber. While in the first position, the upper end 38 of the armature 30 is spaced from the lower end 54 of the support tube 50, creating a gap of approximately sixty microns ($60\times10^{-6}$ meters) between the ends 38 and 54.

The injector 10 further includes an electromagnetic coil assembly 66 that encircles a portion of the jacket 14 and is housed inside a metal housing 68. The electromagnetic coil assembly 66 can be selectively charged to create a magnetic field that attracts the valve member 26 toward the lower end 54 of the support tube 50 (upward in FIG. 1) and into a second position. The biasing force of the spring 62 is overcome such that the ball member 34 is raised from the valve seat 22, allowing fuel to flow through the orifice in the orifice plate 18 and into the combustion chamber. While in the second position, the upper end 38 of the armature 30 contacts the lower end 54 of the support tube 50. The valve member 26 remains in the second position until the charge is removed from the electromagnetic coil assembly 66, at which point the spring 62 biases the valve member 26 back into the first position.

The injector 10 further includes an extension tube 70 that is press-fit and welded into the upper end of the jacket 14. The extension tube 70 is preferably metallic and has an outer surface 74. A fuel filter 78 is captured between the jacket 14 and the extension tube 70 and filters fuel passing through a fuel passageway 82. The fuel passageway 82 provides a path for fuel to travel through the fuel injector 10 and into the combustion chamber, and is defined by the interior space of the extension tube 70, the bore in the adjustment sleeve 58, the bore in the support tube 50, the armature bore 42, the holes 46 and the interior space of the jacket 14.

Figure 5:
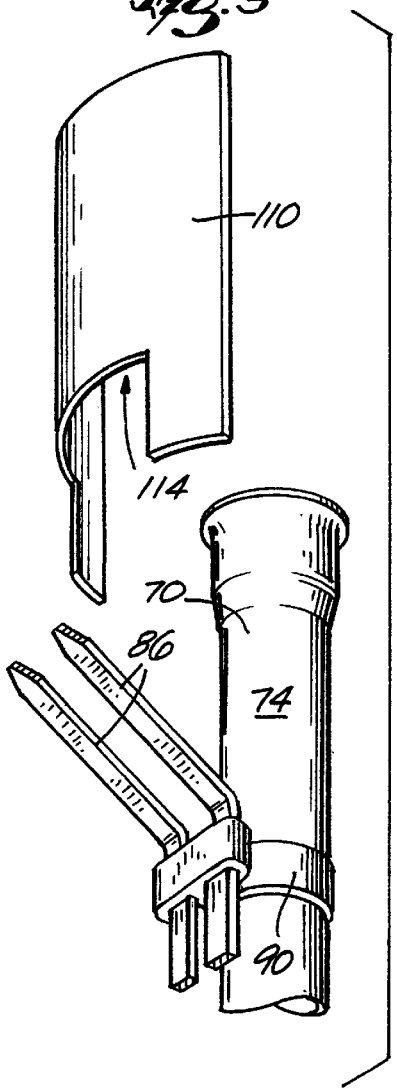
FIG. 5 is a partially exploded view of the fuel injector in FIG. 4 prior to being overmolded.

The electromagnetic coil assembly 66 is selectively charged via an external power lead (not shown) that applies electricity to the electromagnetic coil assembly 66. The power lead is connected to the coil assembly 66 via an electrical clip connector 86 that is mounted (as best seen in FIG. 5) on the outer surface 74 of the extension tube 70 via a clip portion 90. As seen in FIG. 1, the clip connector 86 is electrically connected, via soldering or any other suitable method, to the terminals 94 (only one is shown) extending from the coil assembly 66.

The fuel injector 10 also includes an outer layer or overmolding 98 that surrounds portions of the extension tube 70, clip connector 86, housing 68 and jacket 14. The overmolding 98 is preferably plastic and is preferably molded over the injector 10. In the preferred embodiment, the overmolding 98 is nylon or polyester, but any other suitable material can be used. The overmolding 98 protects the injector 10 from the environment. Additionally, the overmolding 98 helps to support the electrical clip connector 86 and forms a receiving socket 102 that receives the external power lead. Finally, as will be described below, the overmolding 98 plays a key role in reducing noise and vibration emitted from the injector 10 during operation. 0-rings 106 are mounted adjacent both ends of the fuel injector 10.

The repeated movement of the valve member 26 between the first and second positions creates significant vibrations or impulses that are emitted from the fuel injector 10 as audible noise. Every time the valve member 26 moves from the first position to the second position, the upper end 38 of the armature 30 contacts the lower end 54 of the support tube 50. This metal-to-metal contact creates noise and vibration impulses that travel through the metallic jacket 14, housing 68 and extension tube 70. Additionally, when the valve member 26 moves from the second position to the first position, the ball member 34 contacts the metal valve seat 22. This metal-to-metal contact also creates noise and vibration impulses that travel through the metallic jacket 14, housing 68 and extension tube 70.

To alleviate the noise and vibration emitted from the fuel injector 10 during operation, a constrained layer damping technique is used. The constrained layer damping technique involves sandwiching a layer of damping material 110 between inner portions of the injector 10 and the overmolding 98. The damping material 110 can be applied to any outer surface of the fuel injector 10 that is at least partially surrounded by the overmolding 98. Preferably, this involves applying a layer of damping material 110 to the outer surface 74 of the extension tube 70 prior to overmolding the injector 10. The damping material 110 can be any material capable of deforming in shear including, but not limited to, elastic material, viscoelastic material and viscoplastic material.

Most preferably, the damping material 110 is a viscoelastic material. The preferred viscoelastic material can be in the form of a liquid adhesive that can be applied by dipping, brushing, rolling or spraying the extension tube 70, a solid adhesive, such at tape products F9460PC and 9500PC available from the 3M Company, that can be wrapped around the extension tube 70, or a rubber or rubber-like material that is molded or shrunk onto the extension tube 70. In addition to the above-mentioned materials and application techniques, any other suitable material and application technique can be used for the damping material 110.

The damping material 110 can be applied to the extension tube 70 either manually or automatically. If automation is desired, any suitable machines or equipment can be used to dip, brush, roll or spray the extension tube 70 with the liquid viscoelastic material. Likewise, any suitable molding or shrinking techniques and the associated equipment can be used for rubber products. If tape products are used, it is preferred, but not required, to pre-cut the tape product into the specific size necessary to wrap the desired amount of extension tube 70. Again, any suitable application equipment can be used to automatically apply the tape product to the extension tube 70.

The damping material 110 can be applied to the extension tube 70 either before or after the extension tube 70 is pressed into the jacket 14. Additionally, the damping material 110 can be applied to the outer surface 74 of the extension tube 70 either before or after the clip connector 86 is mounted on the extension tube 70.

As seen in FIG. 1, the damping material 110 can be located axially above and adjacent the clip portion 90 of the clip connector 86. The damping material 110 can be applied after the clip connector 86 has been attached to the extension tube 70, or alternatively, the damping material 110 can be applied first and the clip connector 86 can be attached second. If the latter approach is used, the lower edge of the damping material 110 can act as a guide to the placement of the clip portion 90 during assembly. The embodiment shown in FIG. 1 is well-suited for any of the above-mentioned preferred viscoelastic materials and their associated application techniques.

Figure 3:
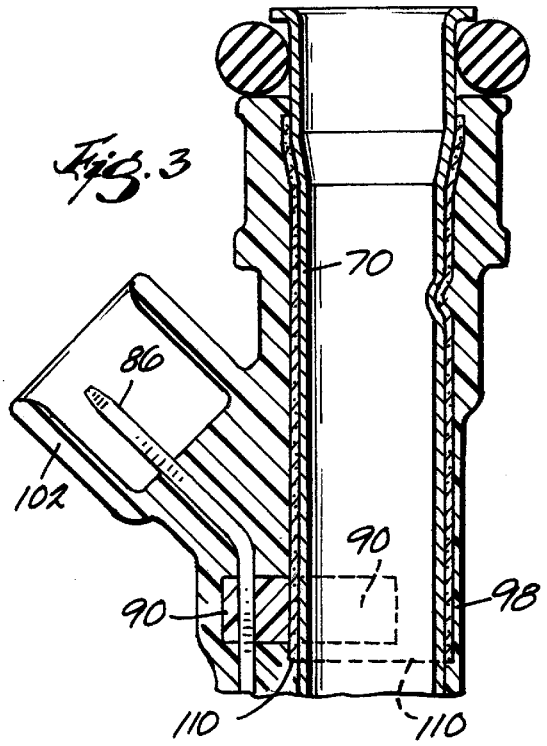
FIG. 3 is a section view of another fuel injector embodying the invention.

FIG. 3 illustrates another embodiment wherein the damping material 110 has been applied to the extension tube 70 prior to attaching the clip connector 86. In this embodiment, the clip connector 86 is mounted directly on and over the previously applied damping material 110. The embodiment shown in FIG. 3 is also well-suited for any of the above-mentioned preferred viscoelastic materials and their associated application techniques.

Figure 4:
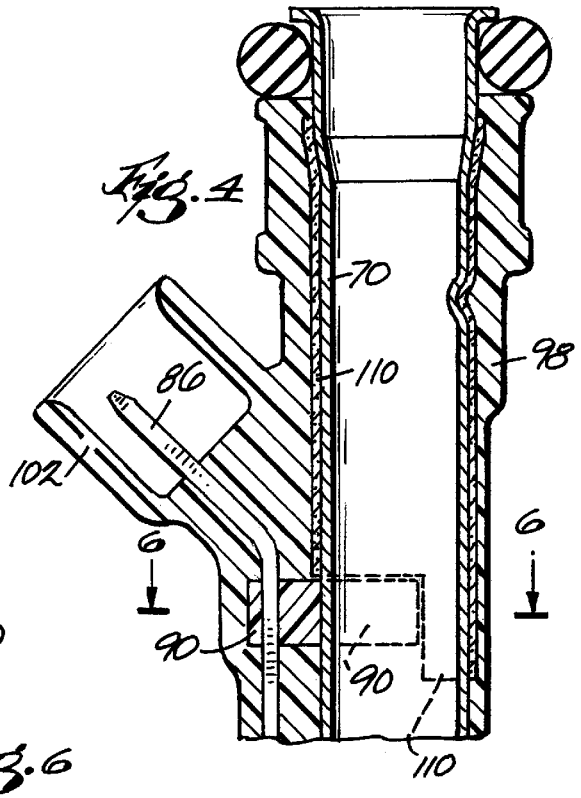
FIG. 4 is a section view of yet another fuel injector embodying the invention.
Figure 6:
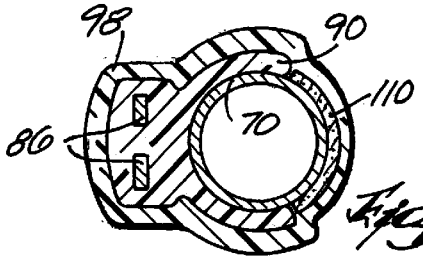
FIG. 6 is a section view taken through line 6—6 in FIG. 4.

FIGS. 4–6 show yet another embodiment wherein the damping material 110 partially surrounds the clip portion 90. While any of the above-mentioned types of viscoelastic material could be used, the embodiment of FIGS. 4–6 would best be achieved using a solid adhesive tape product. When it is desired to apply the tape product around the previously mounted clip connector 86, a specially pre-cut piece of tape product (indicated as the damping material 110 in FIG. 5) can be used to simplify the application. The pre-cut piece of tape product includes a notch 114 that has been cut out or otherwise removed to allow the damping material 110 to be quickly and easily applied around the clip connector 86 and the clip portion 90. Alternatively, if it were desired to attach the clip connector 86 after applying the specially pre-cut piece of tape product, the uncovered area created by the notch 114 could be used as a guide to locating the clip portion 90.

It should be noted that the damping material 110 (whatever the type) need not conform to the coverage illustrated in the figures, but can be applied to cover any desired amount of the injector 10. Furthermore, it is important to remember that the damping material 110 can also be applied to the outer surfaces of the housing 68 or the jacket 14 as desired. Additionally, the damping material 110 can be applied over the clip portion 90 if desired. The present invention is not limited to fuel injectors having extension tubes, housings or jackets of any specific length, shape or outer diameter, but rather can be practiced in conjunction with any fuel injector configurations. Furthermore, the invention is not limited to the specific clip connector configuration.

After the fuel injector 10 is assembled and the damping material 110 has been applied, the fuel injector 10 and the damping material 110 are overmolded with the plastic overmolding 98. The fuel injector 10 now has a first stiff layer (the extension tube 70, and/or the jacket 14, and/or the housing 68, collectively "the body portion"), a damping layer (the damping material 110), and a second stiff layer (the outer layer or overmolding 98). The constrained layer damping occurs when the impulses travelling through the body portion during operation of the fuel injector 10 cause cyclic bending in portions of the body portion. The overmolding 98 then cooperates with and constrains the damping material 110, thereby forcing the energy in the damping material 110 to dissipate in the form of shear deformation. As the energy is dissipated in the damping material 110, the associated vibration and noise is damped or attenuated.

While the preferred constrained layer damping technique is achieved by applying the damping material 110 to the body portion prior to overmolding, it is possible to achieve the same result by applying the damping material 110 to an inner surface of the outer layer or overmolding 98 prior to or while surrounding the body portion. Of course, the damping material 110 must bond with the body portion to be effective. For example, instead of being overmolded, the outer layer 98 could be preformed and shrunk onto the injector 10 after application of the damping material 110 to the inner surface of the preform. Alternatively, coinjection molding techniques could be used to overmold both the damping material 110 and the overmolding 98. As long as the injector includes a damping layer sandwiched between two layers of relatively stiffer material, the constrained layer damping technique can be effectively used.

Various features of the invention are set forth in the following claims.

What is claimed is:

1. A fuel injector assembly comprising:

a body portion;

a valve seat fixed relative to the body portion;

a valve member movable relative to the valve seat;

an outer layer substantially surrounding the body portion; and a damping material between the body portion and the outer layer, the damping material cooperating with the outer layer to dampen noise and vibration produced during operation of the fuel injector.

2. The fuel injector of claim 1, wherein the outer layer is an overmolded plastic.

3. The fuel injector of claim 1, wherein the damping material is a viscoelastic material.

4. The fuel injector of claim 3, wherein the viscoelastic material is an adhesive.

5. The fuel injector of claim 4, wherein the adhesive is a tape product.

6. The fuel injector of claim 3, wherein the viscoelastic material is rubber.

7. The fuel injector of claim 1, further including an electrical connector mounted on the body portion, and wherein the damping material is adjacent to the electrical connector.

8. The fuel injector of claim 1, wherein the body portion defines a fuel passage.

9. The fuel injector of claim 1, wherein the body portion includes an extension tube, and wherein the damping material is between the extension tube and the outer layer.

10. The fuel injector of claim 9, wherein the fuel injector further comprises a jacket that is connected to the extension tube and that houses the valve member.

11. The fuel injector of claim 10, further including an electromagnetic coil assembly for actuating the valve member, the coil assembly partially surrounding the jacket and the coil assembly being surrounded by a housing.

12. A method of manufacturing a fuel injector, the method comprising:

providing a jacket;

inserting a needle assembly into the jacket;

surrounding at least a portion of the jacket with an electromagnetic coil assembly;

applying a damping material to an outer surface of an extension tube;

mounting the extension tube to the jacket; and applying an overmolding over the extension tube and the damping material.

13. The method of claim 12, wherein the overmolding is further applied over the jacket, a housing, and an electrical connector.

14. The method of claim 12, wherein the damping material is applied manually.

15. The method of claim 12, wherein the damping material is applied automatically.

16. The method of claim 12, wherein the damping material is a viscoelastic material.

17. The method of claim 16, wherein the viscoelastic material is an adhesive.

18. The method of claim 17, wherein the adhesive is a tape product.

19. The method of claim 16, wherein the viscoelastic material is rubber.

20. The method of claim 12, further including mounting an electrical connector to the outer surface after applying the damping material.

21. The method of claim 12, further including mounting an electrical connector to the outer surface prior to applying the damping material.

22. The method of claim 12, wherein the extension tube is mounted to the jacket prior to applying the damping material to the outer surface.

23. The method of claim 12, wherein the extension tube is mounted to the jacket after applying the damping material to the outer surface.

24. A method of using constrained layer damping to attenuate noise and vibration in a fuel injector assembly including a first stiff layer and a second stiff layer, the method comprising:

sandwiching a damping layer between the first and second stiff layers.

25. The method of claim 24, wherein the damping layer is applied to one of the first and second stiff layers manually.

26. The method of claim 24, wherein the damping layer is applied to one of the first and second stiff layers automatically.

27. The method of claim 24, wherein the damping layer is a viscoelastic material.

28. The method of claim 27, wherein the viscoelastic material is an adhesive.

29. The method of claim 28, wherein the adhesive is a tape product.

30. The method of claim 27, wherein the viscoelastic material is rubber.

31. The method of claim 24, wherein the first stiff layer is metallic.

32. The method of claim 24, wherein the second stiff layer is plastic.

33. The method of claim 32, wherein the second stiff layer is molded over the first stiff layer and the damping layer.

* * * * *

UNITED STATES PATENT AND TRADEMARK OFFICE

CERTIFICATE OF CORRECTION

PATENT NO. : 6,382,532 B1
DATED : May 7, 2002
INVENTOR(S) : Richard M. French et al.

It is certified that error appears in the above-identified patent and that said Letters Patent is hereby corrected as shown below:

Column 2,
Line 16, "As modem vehicles" should read -- As modern vehicles --

Signed and Sealed this

Third Day of December, 2002

JAMES E. ROGAN
*Director of the United States Patent and Trademark Office*